United States Patent [19]

Mansfield

[11] 4,179,078

[45] Dec. 18, 1979

[54] TOILET PAPER DISPENSER

[76] Inventor: Donna J. Mansfield, 292 D Meridian St., Groton, Conn. 06340

[21] Appl. No.: 949,700

[22] Filed: Oct. 10, 1978

[51] Int. Cl.[2] ..... B65H 19/04; B65H 19/00

[52] U.S. Cl. ..... 242/55.53; 312/39

[58] Field of Search ..... 242/55.53, 55.2, 55.3, 242/55.55, 55.42; 312/39; 70/98, 81, 57

[56] References Cited

U.S. PATENT DOCUMENTS

| | | | |
|---|---|---|---|
| 943,279 | 12/1909 | Smith | 312/39 |
| 2,215,053 | 9/1940 | Reese | 242/55.53 |
| 2,626,761 | 1/1953 | Simpson | 242/55.53 |
| 3,516,615 | 6/1970 | Wickenberg | 242/55.2 |

*Primary Examiner*—Edward J. McCarthy
*Attorney, Agent, or Firm*—Albert W. Hilburger

[57] ABSTRACT

A toilet paper dispenser for mounting on a wall such that a roll of toilet paper is rotatably mounted on a spindle which extends generally perpendicular from a support plate mounted flush with the wall. In one embodiment, an outer plate may be removably mounted at an outer end of the spindle and a locking mechanism associated with the outer plate and with the spindle serves to releasably secure the outer plate to the spindle thereby retaining the roll in position. In other embodiments, a removable cover including sidewalls may be used in place of the outer plate to substantially envelop an unused roll of toilet paper. A locking device on the cover is operable to prevent undesired removal of the roll from the spindle, and a viewing slot can provide a visual determination of the amount of paper remaining on the roll. Alternatively, the cover can be fabricated so as to envelop only the upper portions of a roll, leaving the lower portions exposed. Also a cutting edge may be provided at the lower edge of the cover so that any desired length of paper may be separated from the roll by a user.

18 Claims, 12 Drawing Figures

TOILET PAPER DISPENSER

BACKGROUND OF THE INVENTION

1. Field of the Invention

This invention relates generally to improvements in toilet paper dispensing apparatus.

2. Description of the Prior Art

Various constructions are known for supporting a roll of toilet paper in a conventional fashion, that is wherein the axis of the roll is substantially parallel to a wall or other supporting structure within a bathroom. Representative of one such construction are the patents to Pendergast, U.S. Pat. No. 2,579,201 and Pinkham, Jr., U.S. Pat. No. 2,873,158. In each of these instances sidewalls are provided for supporting the ends of the roll and the apparatus includes a hinged top or front portion which is movable between open and closed positions.

Other representative patents are those to Patterson et al., U.S. Pat. No. 2,487,763 and Marchand, U.S. Pat. No. 2,576,526. In each of these patents, the invention incorporates a casing or enclosure having a pivotally mounted front portion supporting a roll and movable between open and closed position.

In the patent to Chevas, U.S. Pat. No. 3,750,971, a cantilevered roll extends outwardly from one sidewall of the casing or enclosure and the apparatus further includes an integral top and opposite sidewall hinged for movement between open and closed positions.

Still another representative of the prior art is the patent to Girard U.S. Pat. No. 3,475,067, which discloses a dispenser intended for mounting to the upper rim of the toilet bowl rather than to a wall or partition of the bathroom.

SUMMARY OF THE INVENTION

The present invention is considered to be an improvement on the prior art as represented above, and, to this end, comprises a toilet paper dispenser for mounting on a wall such that a roll of toilet paper is rotatably mounted on a spindle which extends generally perpendicular from a support plate mounted flush with the wall. In one embodiment, an outer plate may be removably mounted at an outer end of the spindle and a locking mechanism associated with the outer plate and with the spindle serves to releasably secure the outer plate to the spindle thereby retaining the roll in position. In other embodiments, a removable cover including sidewalls may be used in place of the outer plate to envelop at least an upper half of the roll of toilet paper. A locking device on the cover is operable to prevent undesired removal of the roll from the spindle. In an alternate construction, the cover can be fabricated so as to be substantially coextensive with an unused roll of toilet paper and can be provided with a viewing slot for visual determination of the amount of paper remaining on the roll. Additionally, a lower edge of the cover may be serrated to enable the paper to tear cleanly in any desired length that the user wishes to remove from the roll. In this manner, the need for pre-perforated rolls of toilet paper can be eliminated while the user can draw the desired amount of paper off the roll and sever it from the remainder of the roll.

A primary feature of the invention is the arrangement in which the spindle supporting the roll of toilet paper has a longitudinal axis which is perpendicular, or at least transverse, to the supporting wall. By reason of this construction, a much larger roll of toilet paper can be accommodated resulting in longer periods between needed replenishment. The cover at least partially conceals the roll of toilet paper and is aesthetically pleasing in keeping with modern standards for bathroom construction. Furthermore, to prevent undue pilferage of toilet paper, which is sometimes common in public bathrooms, it is envisioned that the cover may include a locking mechanism to permit only authorized persons to remove the roll or to remove an empty core in preparation for replenishment.

The invention is of simplified construction, is inexpensive to manufacture and can be readily installed. Additionally, it requires a minimum of upkeep, and the cover is easily removed and replaced in the process of replenishing rolls of toilet paper. Other and further objects and advantages will be disclosed or will become apparent from the more detailed description which follows.

It is to be understood that both the foregoing general description and following detailed description are exemplary and explanatory but are not restrictive of the invention.

The accompanying drawings, which are incorporated in, and constitute a part of this invention, illustrate a preferred embodiment of the invention and, together with this description, serve to explain the principles of the invention. Throughout the drawings and specification, like numerals refer to like parts.

DETAILED DESCRIPTION OF THE DRAWINGS

DESCRIPTION OF THE PREFERRED EMBODIMENTS

Figure 1:
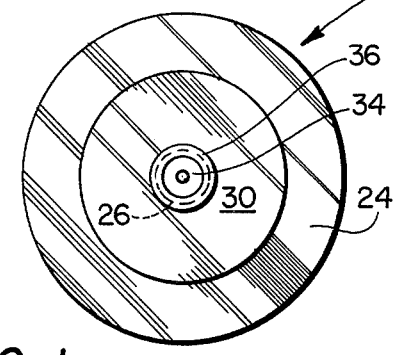
FIG. 1 is a front elevation view of one embodiment of a toilet paper dispenser incorporating the principles of the invention.
Figure 2:
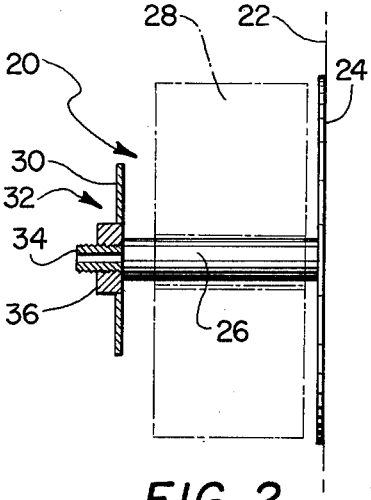
FIG. 2 is a side elevation view of the structure illustrated in FIG. 1, certain parts being cut away and shown in section.

Refer now to the drawings and initially to FIGS. 1 and 2 which illustrate one embodiment of the invention. Specifically, a toilet paper dispenser 20 incorporating the principles of the invention is illustrated mounted on a wall 22 or other appropriate supporting surface within a bathroom.

In accordance with the invention, toilet paper dispensing apparatus comprises a support plate adapted to be mounted to a wall and having portions contiguous with the wall when mounted thereon; a spindle mounted to said plate having a longitudinal axis transverse to a plane of said contiguous portions, said spindle adapted to freely receive thereon a roll of toilet paper; retainer means removably mounted to said spindle adjacent to a free end of said spindle for retaining the roll in position on said spindle; and locking means cooperatively associated with said retainer means and said spindle for releasably securing said retainer means on said spindle.

As embodied herein, with initial reference to FIGS. 1 and 2, a support plate 24 is illustrated mounted to the wall 22 in any suitable fashion, the plate 24 being substantially contiguous with the wall 22. A spindle 26 is mounted to the support plate 24 in such a manner, by any suitable means, that its longitudinal axis is positioned transverse to a plane of the support plate 24. The spindle 26 is adapted to freely receive thereon a roll 28 of toilet paper which is illustrated in phantom. An outer plate 30 serves as a retainer to retain the roll 28 in position on the spindle 26 and lies in a plane substantially parallel with the plane of the support plate 24.

A locking mechanism generally indicated by reference numeral 32 is cooperatively associated with the outer plate 30 and the spindle 26 for releasably securing the outer plate 30 on the spindle. Specifically, the spindle 26 includes a threaded portion 34 adjacent to its free end and a nut member 36 integral with the outer plate 30 is threadedly received on the threaded portion 34. In this manner, the outer plate 30 can be entirely removed from the spindle 26 thereby allowing for removal of the roll 28 from the spindle or insertion of a new roll onto the spindle. Thereupon, the outer plate 30 can once again be threadedly secured to the spindle 26 to retain the roll 28 in position.

In accordance with the invention, the apparatus is generally as previously described wherein said retainer means is a removable cover including sidewalls capable of being moved between a nonfunctional position at a location remote from said support plate to a functional position at which said sidewalls engage said support plate and envelop at least an upper portion of the roll, and wherein said locking means is selectively movable between a first position engaged with said spindle for preventing removal of the cover from said support plate and a second position disengaged from said spindle for allowing removal of said cover from said support plate.

Figure 3:
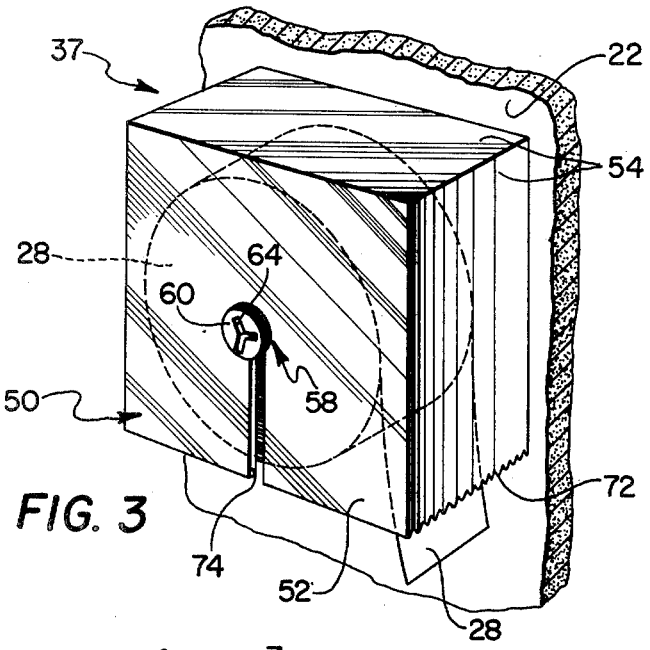
FIG. 3 is a perspective view of another embodiment of a toilet paper dispenser incorporating the principles of the invention which is illustrated mounted in position on a wall or other supporting structure, ready for use.
Figure 4:
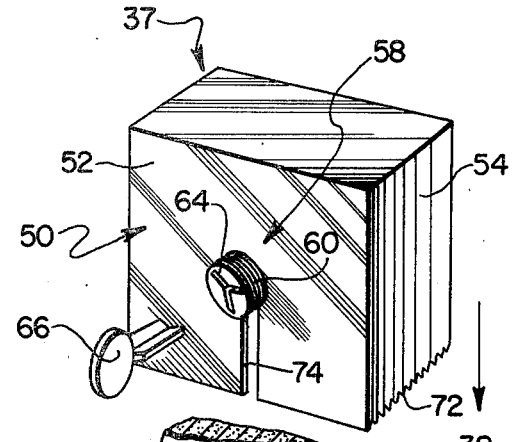
FIG. 4 is an exploded view of the toilet paper dispenser illustrated in FIG. 3.
Figure 5:
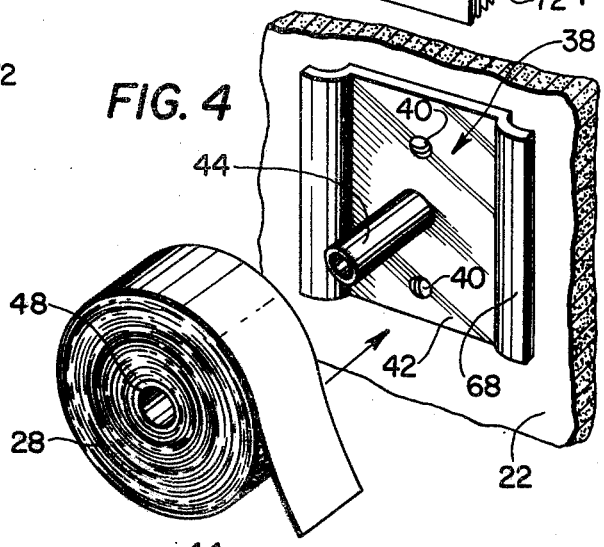
FIG. 5 is a front elevation view of the toilet paper dispenser illustrated in FIG. 3.
Figure 5:
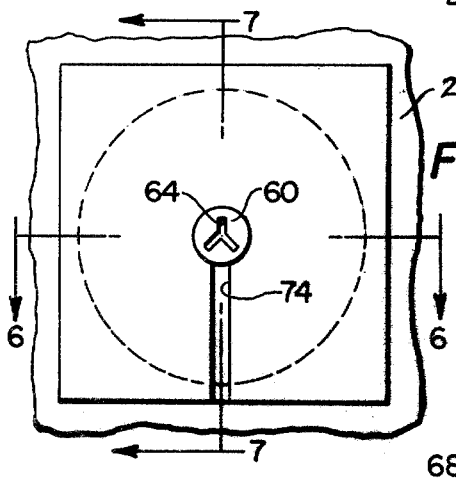
Figure 6:
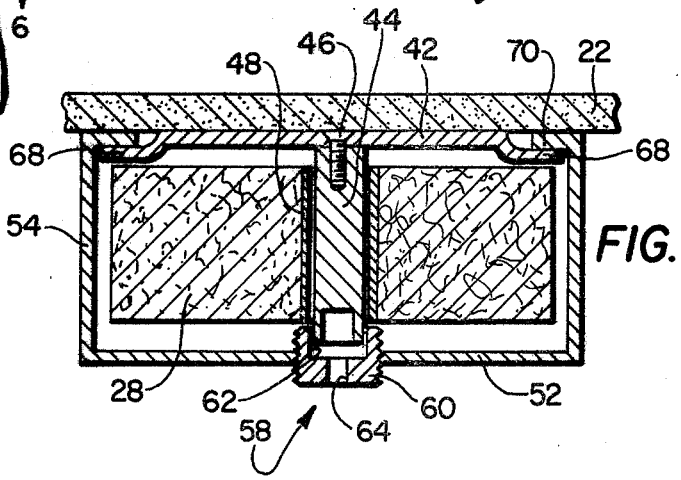
FIG. 6 is a horizontal cross-section view taken generally along line 6—6 in FIG. 5.
Figure 7:
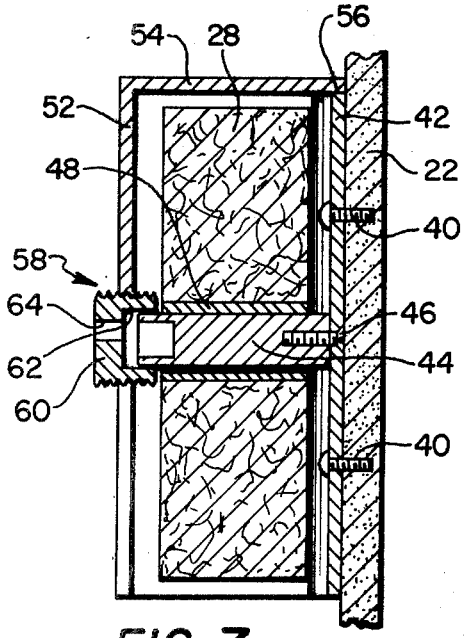
FIG. 7 is a vertical cross-section view taken generally along line 7—7 in FIG. 5.

As embodied herein, with reference to FIGS. 3 and 4 of the drawings, a dispenser 37 depicting another embodiment of the invention includes a support plate which is generally indicated by reference numeral 38. The support plate 38 can be appropriately mounted to the wall 22 by means of suitable fasteners 40, the plate 38 having at least a central member 42 which is contiguous with the wall 22 when securely fastened to the wall.

With particular reference now to FIGS. 3–7, a spindle 44 is mounted to the plate 38 in any suitable fashion such that a longitudinal axis of the spindle is transverse to a plane of the central member 42 of the plate 38. Such a mounting can be achieved by means of a suitable fastener 46. As is particularly well seen in FIG. 4, the spindle 44 has a free end which is adapted to readily receive and support a roll 28 of toilet paper. In a customary fashion, the roll 28 may be provided with a core 48 which has an inner diameter at least slightly larger than an outer diameter of the spindle 44. In this manner, the roll 28 is freely rotatable when supported on the spindle 44.

It will be appreciated that when the roll 28 is positioned on the spindle 44 (see especially FIGS. 6 and 7), the roll 28 is positioned substantially flush with the wall 22. By reason of the construction of the dispenser 37, it is possible to wind the roll so as to have a diameter substantially larger than the diameter of conventional rolls of toilet paper. That is, in conventional constructions, rolls of toilet paper were mounted on spindles parallel to the walls of the bathroom or parallel to other supporting structures thereby substantially limiting the size that a roll could assume. Since the width of a roll is essentially a constant dimension, it will be appreciated that a roll utilized in conjunction with the present invention may have a diameter substantially larger than that of conventional rolls without adversely affecting the utility of the bathroom in which it is located.

A removable cover 50 (FIG. 3) includes a front wall 52 and a plurality of sidewalls 54. The cover 50 is capable of being moved between a non-functional position at a location remote from the support plate 38 to a functional position mounted on the support plate 38 so as to envelop the roll 28 as particularly well seen in FIG. 3. With the cover in its functional position, the front wall 52 lies in a plane substantially parallel to the wall 22 and to the central member 42 and the sidewalls 54 lie in planes generally transverse to the wall 22 and to the front wall 52 of the cover 50.

When the cover 50 is positioned on the support plate 38 such that the upper sidewall 54 of the cover 50 rests upon an upper edge 56 of the central member 42 (see FIG. 7), a locking mechanism generally indicated at 58 can be selectively moved to either prevent removal of the cover 50 from the support plate 38 or to allow for its removal.

In accordance with the invention, the apparatus is generally as previously described wherein said locking means includes a nipple threadedly engaged with said cover so as to be coaxial with said spindle when said cover is in its functional position, said nipple having an inner diameter which is greater than the outer diameter of said spindle, said nipple capable of being threadedly advanced to said first position at which it at least partially envelops a free end of said spindle and prevents removal of said cover from said plate and capable of being threadedly retracted to said second position at which it clears said free end of said spindle permitting removal of said cover from said plate. As embodied herein, with particular reference to FIGS. 6 and 7, it will be appreciated that when the roll 28 is supported on the spindle 44, the outward or free end of the spindle extends beyond the core 48 of the roll. Thus, a nipple 60 which is threadedly engaged with the front wall 52 of the cover 50 is coaxially aligned with the spindle 44 when the upper sidewall 54 engages the upper edge 56. Additionally, the nipple 60 is formed with an interior bore 62 having an inner diameter slightly larger than the outer diameter of the spindle 44. The nipple can be threadedly advanced to a first position (FIG. 6) at which the bore 62 envelops the free end of the spindle 44 thereby preventing removal of the cover 50 from the support plate 38. In an opposite manner, the nipple 60 can be threadedly retracted to a second position (FIG.

7) at which the bore 62 clears the free end of the spindle 44 thereby permitting removal of the cover from the support plate.

In accordance with the invention, the apparatus is generally as previously described wherein said nipple has a slot therethrough and including key means receivable within the slot and selectively turnable for rotating said nipple between said locked and said unlocked positions. As embodied herein, with particular reference to FIGS. 3, 4, and 5, the nipple 60 is provided with a slot 64 having a cross-section illustrated arbitrarily in the form of a "Y". The slot 64 extends at least partially through the nipple 60 and is illustrated as extending completely through the nipple. A conforming key 66 (FIG. 4) may be provided for insertion into the slot 64 to aid in rotation of the nipple 60 between the first and second positions.

In accordance with the invention, the apparatus is as previously described wherein said support plate includes a pair of spaced apart track members raised above the outer surface of the wall when mounted thereon and wherein said sidewalls of said cover terminate at a pair of flanges respectively engageable with said support plate. As embodied herein, with particular reference now to FIGS. 4 and 6, the support plate 38 includes a pair of spaced apart track members 68 which are raised above the outer surface of the wall 22 when the plate 38 is in its mounted position. In effect, the track members 68 are extensions on either side of the central member 42. Cooperating with the track members 68 are a pair of flanges 70 (FIG. 6) formed on the opposed sidewalls 54 of the cover 50. The flanges 70 are received between the track members 68 and the wall 22 preferably in a fitting relationship, to thereby hold the cover 50 in position on the support plate 38.

In accordance with the invention, the apparatus is generally as previously described wherein said cover is open at the bottom and wherein one of said sidewalls has a cutting edge at its lowermost terminus, said cutting edge being substantially parallel with the longitudinal axis of said spindle. As embodied herein, with particular reference to FIGS. 3 and 4, the cover 50 is seen to be open at its bottom or lower regions. Furthermore, a sidewall 54 may be provided at its lowermost terminus with a serrated cutting edge 72 which is substantially parallel with the longitudinal axis of the spindle 44. By reason of this construction, toilet paper utilized in conjunction with the present invention need not be provided with the customary perforations, but can be torn at any of an infinite variety of lengths according to the desires of the user. That is, after a length of paper has been drawn from the roll 28, the user may draw the paper across the cutting edge 72 thereby severing a desired amount from the roll.

In accordance with the invention, the apparatus is generally as previously described wherein said cover is substantially coextensive with an unused roll of toilet paper and wherein at least one of said sidewalls has a slot therein enabling a visual determination of the amount of paper remaining on the roll. As embodied herein, with particular reference to FIGS. 3–5, it is seen that the cover 50 is substantially coextensive with the roll 28 which is illustrated as being an unused roll of toilet paper. A viewing slot 74 is formed in the front wall 52 of the cover 50 and may extend radially outwardly from the nipple 60 so as to enable a visual determination of the amount of paper remaining on the roll.

Figure 8:
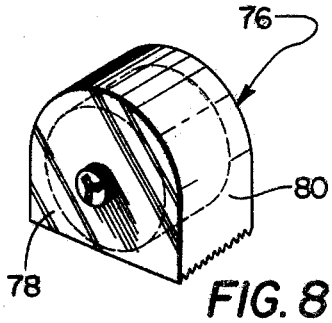
FIG. 8 is a perspective view of yet another embodiment of the invention.
Figure 9:
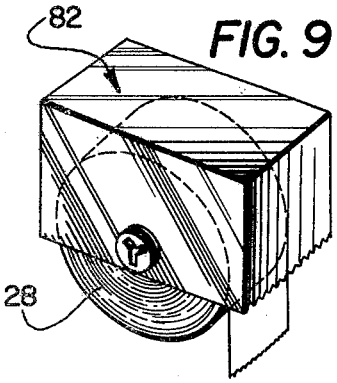
FIG. 9 is a perspective view of still another embodiment of the invention.

FIGS. 8 and 9 illustrate other embodiments of the invention. In FIG. 8, a cover 76 substantially envelops a roll of toilet paper and includes a front wall 78 and a continuous sidewall 80. Such a construction may be desirable from a manufacturing standpoint but is not to be considered a departure from the principles of the invention.

In FIG. 9, a cover 82 is illustrated which only partially envelops a roll of toilet paper. This construction may also be desirable from a manufacturing standpoint as well as to improve visibility of the roll of toilet paper to the user. However, as with the embodiment illustrated in FIG. 8, the cover 82 is not to be considered a departure from the principles of the present invention.

In accordance with the invention, the apparatus is as previously described wherein said retainer means is a cover including sidewalls pivotally mounted on said support plate between a non-functional position distant from said spindle and a functional position at which said sidewalls envelop at least a portion of the roll and wherein said locking means is selectively movable between a first position engaged with said spindle for preventing pivotal movement of the cover and a second position disengaged from said spindle for allowing pivotal movement of said cover to its non-functional position.

Figure 10:
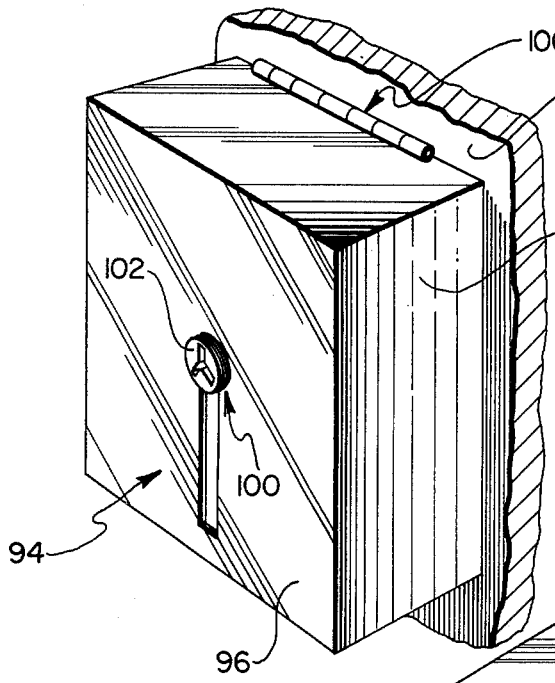
FIG. 10 is a perspective view of still another embodiment of the invention.
Figure 11:
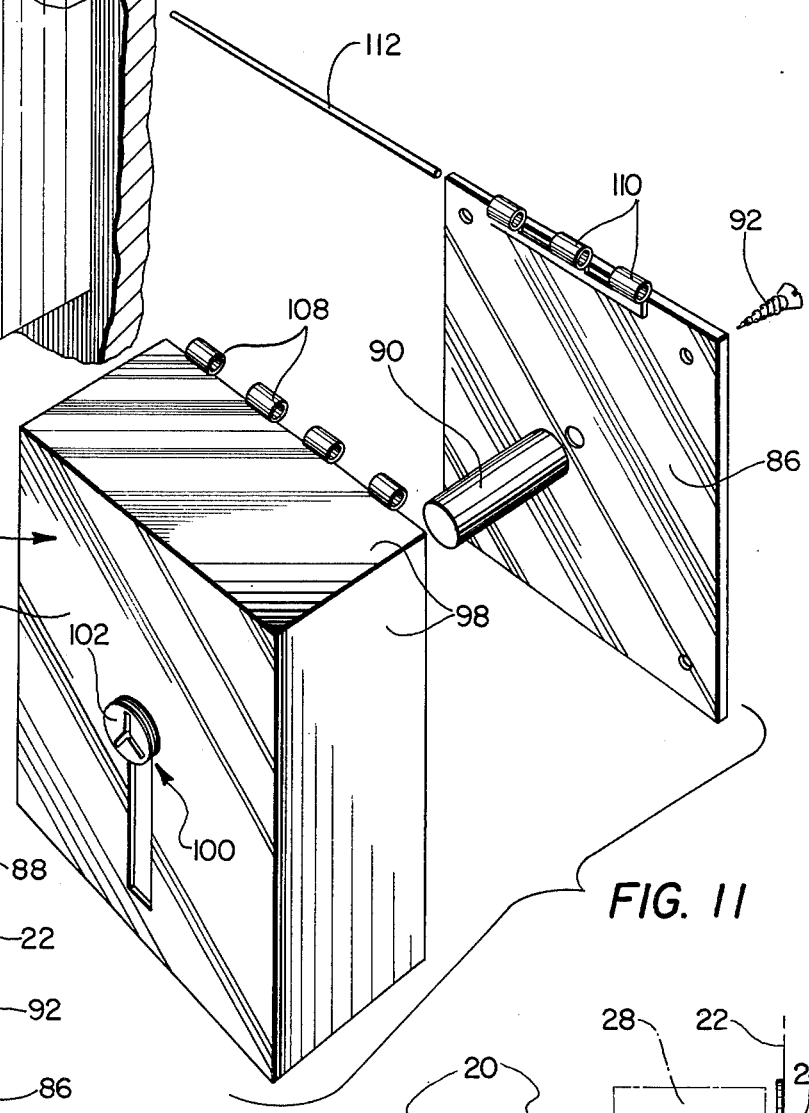
FIG. 11 is an exploded view of the embodiment illustrated in FIG. 10.
Figure 12:
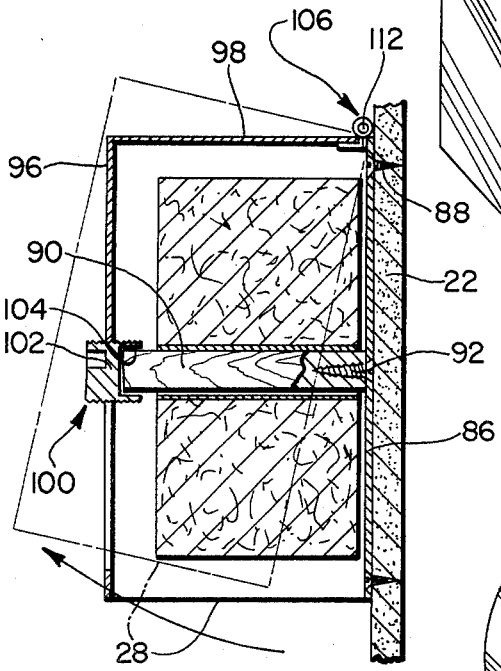
FIG. 12 is a side elevation view, in section, of the embodiment illustrated in FIGS. 10 and 11.

As embodied herein, with particular reference now to FIGS. 10, 11, and 12, a dispenser 94 depicting still another embodiment of the invention includes a support plate 86 appropriately mounted to the wall 22 by means of suitable fasteners 88. The plate 86 is substantially contiguous with the wall when securely fastened to it. A spindle 90 is mounted to the plate 86 in any suitable fashion such that it s longitudinal axis is transverse to a plane of the support plate 86. Such a mounting can be achieved, as previously described, by means of a suitable fastener 92. As is particularly well seen in FIG. 12, the spindle 90 has a free end which is adapted to readily receive and support a roll 28 of toilet paper. In a customary fashion, as previously explained, the roll 28 may be provided with a core 48 which has an inner diameter at least slightly larger than an outer diameter of the spindle 90. In this manner, the roll 28 is freely rotatable when supported on the spindle 90.

A cover 94 includes a front wall 96 and a plurality of sidewalls 98. The cover 94 is capable of being moved between a nonfunctional position as indicated in phantom in FIG. 12 to a functional position as indicated by solid lines in FIG. 12. With the cover in its functional position, the front wall 96 lies in a plane substantially parallel to the wall 22 and to the support plate 86 and the sidewalls 98 lie in planes generally transverse to the wall 22 and to the front wall 96 of the cover 94.

When the cover 94 assumes the functional position as illustrated by solid lines in FIG. 12, a locking mechanism generally indicated at 100 can be selectively moved to either prevent pivotal movement of the cover 94 or to permit for its pivotal movement. The locking mechanism 100 may be substantially the same in construction as the locking mechanism 58 illustrated in FIGS. 6 and 7. Thus, a nipple 102 which is threadedly engaged with the front wall 96 of the cover 94 is coaxially aligned with the spindle 90 when the cover 94 assumes its functional position. Additionally, the nipple 102 is formed with an interior bore 104 having an inner diameter slightly larger than the outer diameter of the spindle 90. The nipple can be threadedly advanced to a first position at which the bore 104 envelops the free end of the spindle 90 thereby preventing movement of the cover 94 to a nonfunctional position. In an opposite manner, the nipple 102 can be threadedly retracted to a second position (not shown) at which the bore 104 clears the free end of the spindle 90 thereby permitting movement of the cover 94 from a functional to a non-functional position.

In accordance with the invention, the apparatus is as previously described wherein said apparatus includes hinge means joining said cover and said support plate to permit movement of said cover between its functional and non-functional positions. As embodied herein, with continuing reference to FIGS. 10–12, a hinge mechanism 106 incorporates cooperative hinge loops 108 and 110 integral, respectively, with the upper sidewall 98 of the cover 94 and of the support plate 86 together with a hinge pin 112 (FIG. 11) which serves to pivotally connect the hinge loops 108 to the hinge loops 110 when the exploded elements illustrated in FIG. 11 are assembled as illustrated in FIG. 12. The hinge mechanism 106 permits movement of the cover 94 between its functional and non-functional positions.

The embodiment of FIGS. 10–12 may additionally incorporate any or all of the additional features described above with respect to the other embodiments of the invention, and it is not deemed necessary to have to describe them again with reference to the embodiment of FIGS. 10–12.

The invention, then, in its broader aspects is not limited to the specific details shown and described, and departures may be made from such details without departing from the principles of the invention, and without sacrificing its chief advantages.

What is claimed is:

1. Toilet paper dispensing apparatus comprising:

a support plate adapted to be mounted to a wall and having portions contiguous with the wall when mounted thereon;

a spindle mounted to said plate having a longitudinal axis transverse to a plane of said contiguous portions, said spindle adapted to freely receive thereon a roll of toilet paper;

retainer means removably mounted to said spindle adjacent to a free end of said spindle for retaining the roll in position on said spindle; and locking means cooperatively associated with said retainer means and said spindle for releasably securing said retainer means on said spindle.

2. Toilet paper dispensing apparatus as set forth in claim 1 wherein said retainer means includes an outer plate lying in a plane substantially parallel with a plane of said contiguous portions, and wherein said spindle includes a threaded portion adjacent to its free end and wherein a nut member integral with said retainer means is threadedly received on said threaded portion, said locking means comprising said threaded portion and said nut member.

3. Toilet paper dispensing apparatus as set forth in claim 1 wherein said retainer means is a removable cover including sidewalls capable of being moved between a non-functional position at a location remote from said support plate to a functional position at which said sidewalls engage said support plate and envelop at least an upper portion of the roll and wherein said locking means is selectively movable between a first position engaged with said spindle for preventing removal of said cover from said support plate and a second position disengaged from said spindle for allowing removal of said cover from said support plate.

4. Toilet paper dispensing apparatus as set forth in claim 3 wherein said locking means includes a nipple threadedly engaged with said cover so as to be coaxial with said spindle when said cover is in its functional position, said nipple having an inner diameter which is greater than the outer diameter of said spindle, said nipple capable of being threadedly advanced to said first position at which it at least partially envelops a free end of said spindle and prevents removal of said cover from said plate and capable of being threadedly retracted to said second position at which it clears said free end of said spindle permitting removal of said cover from said plate.

5. Toilet paper dispensing apparatus as set forth in claim 4 wherein said nipple has a slot therethrough and including key means receivable within the slot and selectively turnable for rotating said nipple between said first and said second positions.

6. Toilet paper dispensing apparatus as set forth in claim 3 wherein said support plate includes a pair of spaced apart track members raised above the outer surface of the wall when mounted thereon and wherein said sidewalls of said cover terminate at a pair of flanges respectively engageable with said support plate.

7. Toilet paper dispensing apparatus as set forth in claim 3 wherein said cover is open at the bottom and wherein one of said sidewalls has a cutting edge at its lowermost terminus, said cutting edge being substantially parallel with the longitudinal axis of said spindle.

8. Toilet paper dispensing apparatus as set forth in claim 3 wherein said cover is substantially coextensive with an unused roll of toilet paper and wherein at least one of said sidewalls has a slot therein enabling a visual determination of the amount of paper remaining on the roll.

9. Toilet paper dispensing apparatus as set forth in claim 3 wherein said cover includes a first sidewall lying in a plane substantially parallel with said contiguous portions when said cover is in its functional position and at least one second sidewall lying in a plane generally transverse to that of said first sidewall and integral therewith.

10. Toilet paper dispensing apparatus as set forth in claim 3 wherein said cover includes a first sidewall lying in a plane substantially parallel with said contiguous portions when said cover is in its functional position and a plurality of second sidewalls lying in planes generally transverse to that of said first sidewall and integral therewith.

11. Toilet paper dispensing apparatus as set forth in claim 1 wherein said retainer means is a cover including sidewalls pivotally mounted on said support plate between a non-functional position distant from said spindle and a functional position at which said sidewalls envelop at least a portion of the roll and wherein said locking means is selectively movable between a first position engaged with said spindle for preventing pivotal movement of said cover and a second position disengaged from said spindle for allowing pivotal movement of said cover to its non-functional position.

12. Toilet paper dispensing apparatus as set forth in claim 11 wherein said locking means includes a nipple threadedly engaged with said cover so as to be coaxial with said spindle when said cover is in its functional position, said nipple having an inner diameter which is greater than the outer diameter of said spindle, said nipple capable of being threadedly advanced to said first position at which it at least partially envelops a free end of said spindle and prevents removal of said cover from said plate and capable of being threadedly retracted to said second position at which it clears said free end of said spindle permitting removal of said cover from said plate.

13. Toilet paper dispensing apparatus as set forth in claim 12 wherein said nipple has a slot therethrough and including key means receivable within the slot and selectively turnable for rotating said nipple between said first and said second positions.

14. Toilet paper dispensing apparatus as set forth in claim 11 including hinge means joining said cover and said support plate to permit movement of said cover between its functional and non-functional positions.

15. Toilet paper dispensing apparatus as set forth in claim 11 wherein said cover is open at the bottom and wherein one of said sidewalls has a cutting edge at its lowermost terminus, said cutting edge being substantially parallel with the longitudinal axis of said spindle.

16. Toilet paper dispensing apparatus as set forth in claim 11 wherein said cover is substantially coextensive with an unused roll of toilet paper and wherein at least one of said sidewalls has a slot therein enabling a visual determination of the amount of paper remaining on the roll.

17. Toilet paper dispensing apparatus as set forth in claim 11 wherein said cover includes a first sidewall lying in a plane substantially parallel with said contiguous portions when said cover is in its functional position and at least one second sidewall lying in a plane generally transverse to that of said first sidewall and integral therewith.

18. Toilet paper dispensing apparatus as set forth in claim 11 wherein said cover includes a first sidewall lying in a plane substantially parallel with said contiguous portions when said cover is in its functional position and a plurality of second sidewalls lying in planes generally transverse to that of said first sidewall and integral therewith.

* * * * *